US010619460B2

(12) United States Patent
Fripp et al.

(10) Patent No.: US 10,619,460 B2
(45) **Date of Patent: *Apr. 14, 2020**

(54) ANNULAR FLOW CONTROL DEVICES AND METHODS OF USE

(71) Applicant: Halliburton Energy Services, Inc., Houston, TX (US)

(72) Inventors: Michael Linley Fripp, Carrollton, TX (US); John Gano, Carrollton, TX (US); Jean Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 270 days.

This patent is subject to a terminal disclaimer.

(21) Appl. No.: 15/040,392

(22) Filed: Feb. 10, 2016

(65) Prior Publication Data

US 2016/0160580 A1 Jun. 9, 2016

Related U.S. Application Data

(63) Continuation of application No. 14/234,161, filed as application No. PCT/US2013/033833 on Mar. 26, 2013, now Pat. No. 9,291,030.

(51) Int. Cl.

| | |
|---|---|
| ***E21B 43/12*** | (2006.01) |
| ***E21B 43/08*** | (2006.01) |
| ***E21B 34/06*** | (2006.01) |
| ***E21B 17/18*** | (2006.01) |
| ***E21B 43/24*** | (2006.01) |

(52) U.S. Cl.

CPC ..... *E21B 43/12* (2013.01); *E21B 17/18* (2013.01); *E21B 34/06* (2013.01); *E21B 43/08* (2013.01); *E21B 43/082* (2013.01); *E21B 43/2406* (2013.01)

(58) Field of Classification Search

CPC ..... E21B 43/12; E21B 43/16; E21B 34/06; E21B 17/18

See application file for complete search history.

(56) References Cited

U.S. PATENT DOCUMENTS

| | | | | |
|---|---|---|---|---|
| 6,540,022 | B2 * | 4/2003 | Dusterhoft | E21B 34/06 166/236 |
| 6,601,646 | B2 | 8/2003 | Streich et al. | |
| 7,581,593 | B2 | 9/2009 | Pankratz et al. | |

(Continued)

FOREIGN PATENT DOCUMENTS

WO 2014158138 A1 10/2014

OTHER PUBLICATIONS

International Search Report and Written Opinion for PCT/US2013/033833 dated Oct. 25, 2013.

*Primary Examiner* — Nicole Coy
(74) *Attorney, Agent, or Firm* — McGuireWoods LLP

(57) ABSTRACT

A flow control device includes an annular inner shroud coupled to a work string that defines one or more flow ports therein, and an annular outer shroud also coupled to the work string and radially offset from the inner shroud such that a channel is defined between at least a portion of the inner and outer shrouds. The channel is in fluid communication with at least one of the one or more flow ports and configured to restrict a flow rate of a fluid. The work string has a central axis and the inner and outer shrouds extend longitudinally within the work string.

16 Claims, 8 Drawing Sheets

(56) References Cited

U.S. PATENT DOCUMENTS

| | | | | |
|---|---|---|---|---|
| 7,918,272 | B2 * | 4/2011 | Gaudette | E21B 34/08 166/205 |
| 2008/0236842 | A1 | 10/2008 | Bhaysar et al. | |
| 2010/0155064 | A1 * | 6/2010 | Nutley | E21B 33/1208 166/278 |
| 2010/0180972 | A1 * | 7/2010 | Yoon | F16L 1/15 138/39 |
| 2010/0294495 | A1 | 11/2010 | Clarkson et al. | |
| 2011/0042091 | A1 | 2/2011 | Dykstra et al. | |
| 2011/0100642 | A1 | 5/2011 | Cens et al. | |
| 2011/0186300 | A1 * | 8/2011 | Dykstra | E21B 34/08 166/316 |
| 2011/0226481 | A1 * | 9/2011 | Duphorne | E21B 43/12 166/313 |
| 2012/0152528 | A1 | 6/2012 | Greci | |
| 2012/0298356 | A1 | 11/2012 | Sladic et al. | |

* cited by examiner

ANNULAR FLOW CONTROL DEVICES AND METHODS OF USE

BACKGROUND

The present disclosure is generally related to controlling fluid flow in a wellbore and, more particularly, to annular flow control devices and their methods of use.

Recovery of valuable hydrocarbons in some subterranean formations can sometimes be difficult due to a relatively high viscosity of the hydrocarbons and/or the presence of viscous tar sands in the formations. In particular, when a production well is drilled into a subterranean formation to recover oil residing therein, often little or no oil flows into the production well even if a natural or artificially induced pressure differential exists between the formation and the well. To overcome this problem, various thermal recovery techniques have been used to decrease the viscosity of the oil and/or the tar sands, thereby making the recovery of the oil easier.

Steam assisted gravity drainage (SAGD) is one such thermal recovery technique and utilizes steam to thermally stimulate viscous hydrocarbon production by injecting steam into the subterranean formation to the hydrocarbons residing therein. As the temperature of the hydrocarbons increases, they are able to more easily flow to a production well to be produced to the surface. During injection of the steam, however, the steam is often not evenly distributed throughout the length of the wellbore such that a temperature gradient or energy gradient along the wellbore is generated and consists of some areas that are hotter or have more potential energy than other areas. As a result, hydrocarbons are often only efficiently produced across a narrow window of the wellbore where the temperature is able to increase to an effective point.

A number of devices are available for regulating the flow of steam into subterranean formations. Some of these devices are non-discriminating for different types of fluids and simply function as a "gatekeeper" for regulating injection rates of the steam into the formation. Such gatekeeper devices can be simple on/off valves or they can be metered to regulate fluid flow over a continuum of flow rates. Other types of devices that may be used to regulate the flow of steam into subterranean formations include tubular flow restrictors, nozzle-type flow restrictors, ports, tortuous paths, and other flow control devices. Such standard flow control devices, however, tend to expel steam at one point in the wellbore and water at another point. This is partially due to the effects of gravity on the steam, but also due to the fact that the steam can more easily exit through a flow control device as opposed to water flowing with the steam.

It would prove advantageous to have a system that uses flow control devices that are able to deliver a consistent heat flow along the entire length of a wellbore. It would similarly prove advantageous to have a system that uses flow control devices that are able to deliver a similar quantity of water and steam (assuming wet steam) into each section of the wellbore and otherwise deliver a consistent pressure drop along such lengths of the wellbore.

SUMMARY OF THE DISCLOSURE

The present disclosure is generally related to controlling fluid flow in a wellbore and, more particularly, to annular flow control devices and their methods of use.

In some embodiments, a flow control device may be disclosed and may include an annular inner shroud coupled to a work string that defines one or more flow ports therein, and an annular outer shroud also coupled to the work string and radially offset from the inner shroud such that a channel is defined between at least a portion of the inner and outer shrouds, the channel being in fluid communication with at least one of the one or more flow ports and configured to restrict a flow rate of a fluid.

In some embodiments, a method of regulating a flow of a fluid may be disclosed. The method may include conveying the fluid in a work string defining one or more flow ports therein, receiving a portion of the fluid in an annular flow control device coupled to the work string and including an inner shroud and an outer shroud radially offset from the inner shroud and defining a channel therebetween to receive the portion of the fluid, the channel being in fluid communication with at least one of the one or more flow ports, and conducting the portion of the fluid through the channel and the at least one of the one or more flow ports, and thereby creating a flow restriction on the fluid through the annular flow control device.

In some embodiments, another method of regulating a flow of a fluid may be disclosed and may include drawing the fluid into a work string defining one or more flow ports therein, receiving the fluid in an annular flow control device coupled to the work string and including an inner shroud and an outer shroud radially offset from the inner shroud such that a channel is defined therebetween to receive the fluid, the channel being in fluid communication with at least one of the one or more flow ports, and conducting the fluid through the channel and the at least one of the one or more flow ports, and thereby creating a flow restriction on the fluid through the annular flow control device.

The features of the present disclosure will be readily apparent to those skilled in the art upon a reading of the description of the embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure is generally related to controlling fluid flow in a wellbore and, more particularly, to annular flow control devices and their methods of use.

Disclosed are various embodiments of flow control devices that may be used for injection or production operations in oil and gas wells. The disclosed flow control devices may be well suited and otherwise prove advantageous for steam assisted gravity drainage (SAGD) operations. For instance, the exemplary flow control devices described herein provide an annular structure that is able to deliver a consistent heat flow (or thermal energy) along the entire length of a horizontal injection well. Moreover, because of the annular structural design, the disclosed flow control devices may be able to deliver a consistent pressure drop along the length of the injection well, thereby being able to deliver a similar quantity of water and steam (assuming wet steam) into each section.

The exemplary flow control devices may also include various fluidic features, such as dimples, fluidic diodes, a porous medium, and tortuous flow paths, all of which increase the flow path length and promote increase pressure drop. As a result, the disclosed flow control devices may be effective and otherwise advantageous in controlling the injection of a mixed fluid, such as an injected steam that includes both gaseous and aqueous components. For instance, the gaseous and aqueous components may be trapped by the annular structure and otherwise contained in a section of lower velocity and by a cross-section that is parallel to their flow direction.

Figure 1:
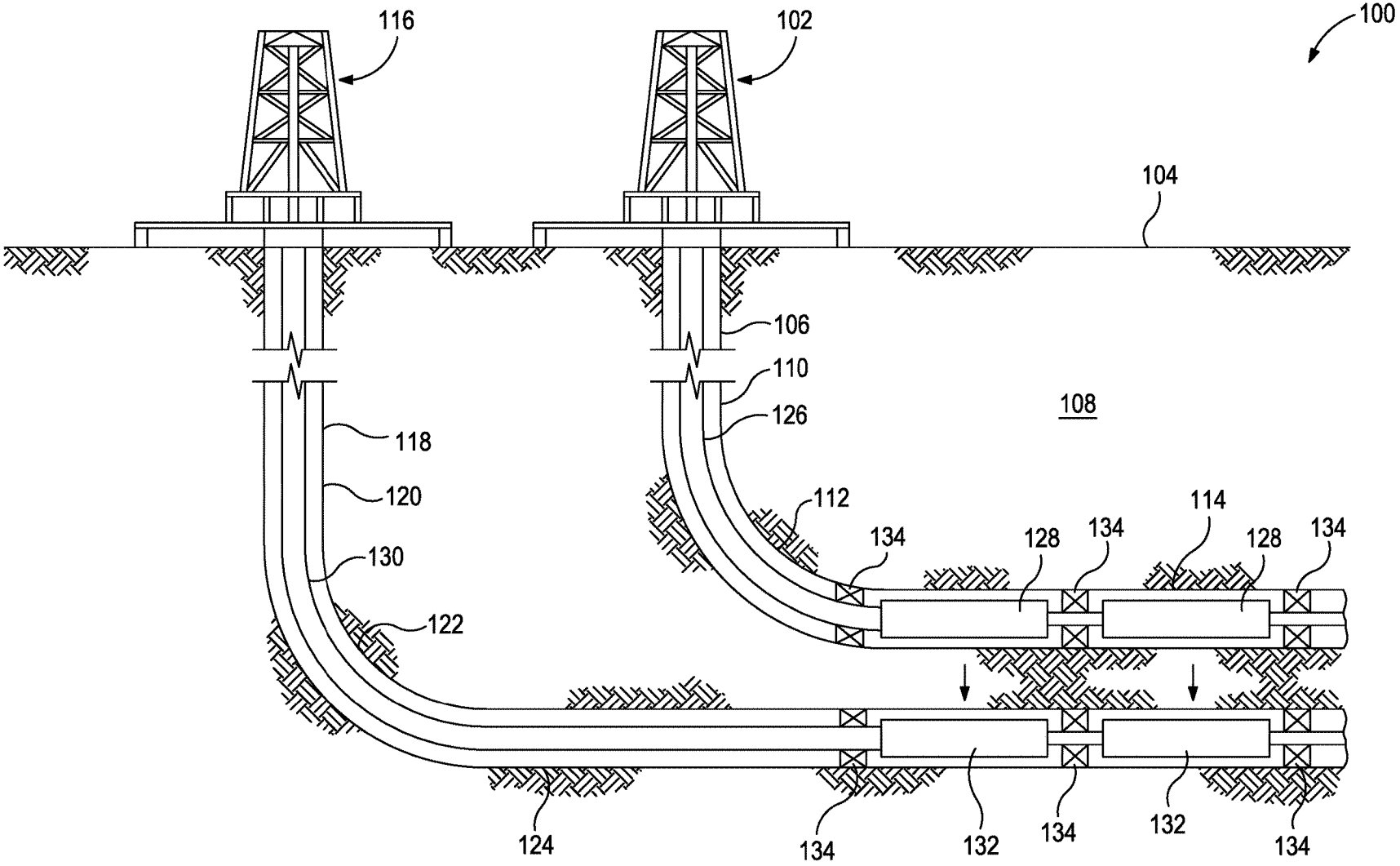
FIG. 1 illustrates a well system that may embody or otherwise employ one or more principles of the present disclosure, according to one or more embodiments.

Referring to FIG. 1, illustrated is a well system 100 that may embody or otherwise employ one or more principles of the present disclosure, according to one or more embodiments. As illustrated, the well system 100 may be configured for producing and/or recovering hydrocarbons using a steam assisted gravity drainage (SAGD) method. Those skilled in the art, however, will readily appreciate that the presently described embodiments may be useful in other types of hydrocarbon recovery operations, without departing from the scope of the disclosure.

The depicted system 100 may include an injection service rig 102 that is positioned on the earth's surface 104 and extends over and around an injection wellbore 106 that penetrates a subterranean formation 108. The injection service rig 102 may include a drilling rig, a completion rig, a workover rig, or the like. The injection wellbore 106 may be drilled into the subterranean formation 108 using any suitable drilling technique and may extend in a substantially vertical direction away from the earth's surface 104 over a vertical injection wellbore portion 110. At some point in the injection wellbore 106, the vertical injection wellbore portion 110 may deviate from vertical relative to the earth's surface 104 over a deviated injection wellbore portion 112 and may further transition to a horizontal injection wellbore portion 114, as illustrated. In some embodiments, for example, the wellbore 106 may be angled past 90° or otherwise angled up toward the surface 104, without departing from the scope of the disclosure.

The system 100 may further include an extraction service rig 116 (e.g., a drilling rig, completion rig, workover rig, and the like) that may also be positioned on the earth's surface 104. The service rig 116 may extend over and around an extraction wellbore 118 that also penetrates the subterranean formation 108. Similar to the injection wellbore 106, the extraction wellbore 118 may be drilled into the subterranean formation 108 using any suitable drilling technique and may extend in a substantially vertical direction away from the earth's surface 104 over a vertical extraction wellbore portion 120. At some point in the extraction wellbore 118, the vertical extraction wellbore portion 120 may deviate from vertical relative to the earth's surface 104 over a deviated extraction wellbore portion 122, and transition to a horizontal extraction wellbore portion 124. As illustrated, at least a portion of horizontal extraction wellbore portion 124 may be vertically offset from and otherwise disposed below the horizontal injection wellbore portion 114.

While the injection and extraction service rigs 102, 116 are depicted in FIG. 1, in some embodiments one or both of the service rigs 102, 116 may be omitted and otherwise replaced with a standard surface wellhead completion or installation that is associated with the system 100. Moreover, while the well system 100 is depicted as a land-based operation, it will be appreciated that the principles of the present disclosure could equally be applied in any sub-sea application where either service rig 102, 116 may be replaced with a sub-surface wellhead installation, as generally known in the art.

The system 100 may further include an injection work string 126 (e.g., production string/tubing) that extends into the injection wellbore 106. The injection work string 126 may include a plurality of injection tools 128, each injection tool 128 being configured for an outflow control configuration such that a fluid (e.g., steam) may be effectively injected into the surrounding subterranean formation 108. Similarly, the system 100 may include an extraction work string 130 (e.g., production string/tubing) that extends into the extraction wellbore 118. The extraction work string 130 may include a plurality of production tools 132, each production tool being configured for an inflow control configuration such that a flow of hydrocarbons may be drawn into the extraction work string 130 from the surrounding subterranean formation 108.

One or more wellbore isolation devices 134 (e.g., packers, gravel pack, collapsed formation, or the like) may be used to isolate annular spaces of both the injection and extraction wellbores 106, 118. As illustrated, the isolation devices 134 may be configured to substantially isolate separate injection and production tools 128, 132 from each other within their corresponding injection and extraction wellbore 106, 118, respectively. As a result, fluids may be injected into the formation 108 at discrete and separated intervals via the injection tools 128 and fluids may subsequently be produced from multiple intervals or "pay zones" of the formation 108 via isolated production tools 132 arranged along the extraction work string 130.

While the system 100 is described above as comprising two separate wellbores 106, 118, other embodiments may be configured differently, without departing from the scope of the disclosure. For example, in some embodiments the work strings 126, 130 may both be located in a single wellbore. In other embodiments, vertical portions of the work strings 126, 130 may both be located in a common wellbore but may each extend into different deviated and/or horizontal wellbore portions from the common vertical portion. In yet other embodiments, the vertical portions of the work strings 126, 130 may be located in separate vertical wellbore portions but may both be located in a shared horizontal wellbore portion.

In each of the above described embodiments, the injection and production tools 128, 132 may be used in combination and/or separately to deliver fluids to the wellbore with an outflow control configuration and/or to recover fluids from the wellbore with an inflow control configuration. Still further, in other embodiments, any combination of injection and production tools 128, 132 may be located within a shared wellbore and/or amongst a plurality of wellbores and the injection and production tools 128, 132 may be associated with different and/or shared isolated annular spaces of the wellbores, the annular spaces, in some embodiments, being at least partially defined by one or more zonal isolation devices 134.

In exemplary operation of the well system 100, a fluid (e.g., steam) may be conveyed into the injection work string 126 and ejected therefrom via the injection tools 128 and into the surrounding formation 108. Introducing steam into the formation 108 may reduce the viscosity of some hydrocarbons affected by the injected steam, thereby allowing gravity to draw the affected hydrocarbons downward and into the extraction wellbore 118. The extraction work string 130 may be caused to maintain an internal bore pressure (e.g., a pressure differential) that tends to draw the affected hydrocarbons into the extraction work string 130 through the production tools 132. The hydrocarbons may thereafter be pumped out or flowed out of the extraction wellbore 118 and into a hydrocarbon storage device and/or into a hydrocarbon delivery system (i.e., a pipeline).

While FIG. 1 depicts only two injection and production tools 128, 132, respectively, those skilled in the art will readily appreciate that more than two injection and production tools 128, 132 may be employed in each of the injection and extraction work strings 126, 130, without departing from the scope of the disclosure. Moreover, although FIG. 1 depicts the injection and production tools 128, 132 as being positioned in the substantially horizontal portions 114, 124, respectively, the injection and production tools 128, 132 may equally be arranged, either additionally or alternatively, in the substantially vertical portions 110, 120, without departing from the scope of the disclosure.

Each of the injection and production tools 128, 132 may include at least one flow control device (not shown) configured to restrict or otherwise regulate the flow of fluids out of the injection work string 126 and/or into the extraction work string 130, respectively. One challenge presented to well operators is injecting or producing uniform or substantially uniform amounts of fluid through traditional flow control devices along the length of the injection and extraction work strings 126, 130 where the injection and production tools 128, 132 are located. For example, when steam is being injected into the formation 108, the gaseous component of the steam is more readily injected near the heel of a well through traditional flow control devices, while a good portion of the aqueous component of the steam (i.e., water) is more likely to congregate and be injected near the toe of the well.

In vertical injection wells, the water typically passes the injection ports of a typical flow control device and falls to the toe. This drastically decreases the injection of steam at the toe and rather favors water injection at the toe. In horizontal injection wells, on the other hand, there are usually limited flow ports for traditional flow control devices and, in some applications, there is only one flow port per section of tubing. The location of the flow ports often have a random orientation and thus some flow ports will be filled with water and some will be out of the water. The result is that the heat flow into the subterranean formation 108 may not be uniform along the length of the injection work strings 126 where the injection tools 128 are located.

Figure 2:
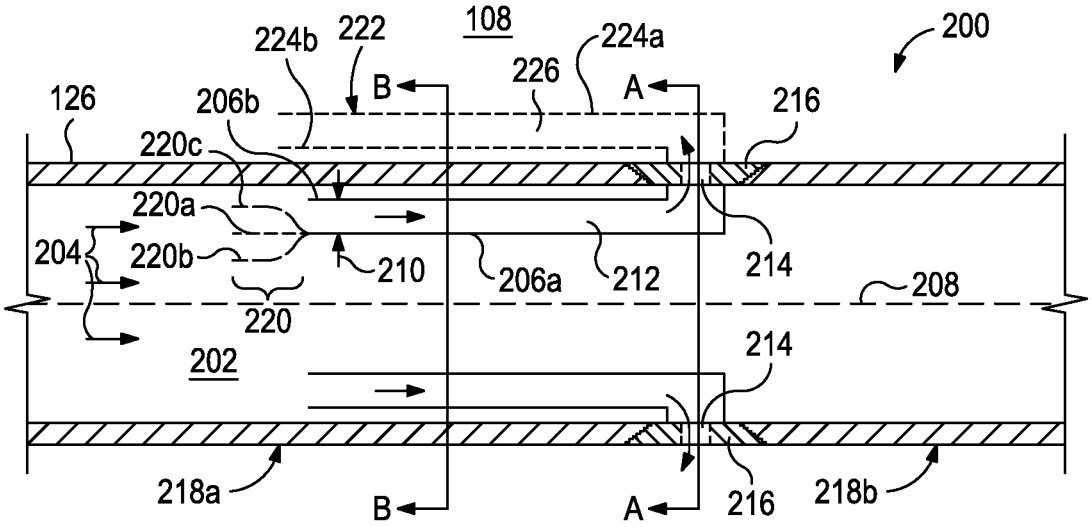
FIG. 2 is a cross-sectional view of a portion of an exemplary flow control device, according to one or more embodiments.

Referring now to FIG. 2, with continued reference to FIG. 1, illustrated is a cross-sectional view of a portion of an exemplary flow control device 200, according to one or more embodiments. The flow control device 200 may be a generally annular structure that may be used in one or both of the injection and production tools 128, 132 of FIG. 1 to regulate the flow of a fluid 202, such as steam. As used herein, the term "annular" means shaped like or in the general form of a ring. As will be appreciated by those skilled in the art, an annular-shaped flow control device 200 may prove advantageous in achieving substantially uniform steam flow into the formation 108 at all of the zones in both vertical and horizontal wells. Moreover, an annular-shaped flow control device 200 may facilitate water exit potential about the entire circumference of the injection work string 126 in a horizontal well. Due to the thinness of the exemplary flow control device 200, some water is allowed to bypass the flow control device 200 to be conveyed further downhole (i.e., toward the toe of the well). As a result, the exemplary flow control device 200 may achieve a better injection heat flow into the formation 108 along the length of the injection work string 126 where the injection tools 128 may be located.

The flow control device 200, as depicted in FIG. 2, is used in conjunction with the injection work string 126 and an injection tool 128 (FIG. 1) to regulate the flow of the fluid 202 out of the injection work string 126 and into the surrounding subterranean formation 108. It will be appreciated, however, that the flow control device 200 may equally be used with the production work string 130 and a production tool 132 configured to draw a fluid therein for production, without departing from the scope of the disclosure. Moreover, it will be appreciated that, while the flow control device 200 is depicted as being arranged in a substantially horizontal section of the work string 126, the flow control device 200 may equally be used or otherwise installed in a substantially vertical or deviated portion of the work string, without departing from the scope of the disclosure.

In some embodiments, the fluid 202 may be steam flowing in the downhole direction as indicated by the arrows 204. The steam may be a dry steam and entirely composed of a gas. In other embodiments, however, the steam may include both gaseous and aqueous components. In at least one embodiment, the fluid 202 may be injected into the surrounding formation 108 for the purposes of steam assisted gravity drainage (SAGD) operations. In other embodiments, the fluid 202 may be any other type of fluid that may be injected into the formation 108 for other wellbore operations, without departing from the scope of the disclosure.

In some embodiments, the flow control device 200 may include an inner shroud 206*a* and an outer shroud 206*b* arranged within the work string 126. The inner shroud 206*a* may be radially offset from the outer shroud 206*b* toward a central axis 208 of the work string 126, and the outer shroud 206*b* may be radially offset from the inner surface of the work string 126 toward the central axis 208. In other embodiments, however, the outer shroud 206*b* may be omitted or otherwise replaced functionally by the work string 126 itself. In other words, the work string 126 may functionally serve as the outer shroud 206*b* in at least some embodiments, without departing from the scope of the disclosure.

The inner and outer shrouds 206*a,b* may be radially offset from each other a short distance 210 so as to define a narrow channel 212 therebetween. The channel 212 may create or otherwise define an annular area that generates a flow restriction for the fluid 202 and simultaneously create back pressure on the fluid 202 as it enters the channel 212. Accordingly, the channel 212 may prove advantageous in maximizing the sensitivity to viscosity of the fluid 202 and simultaneously minimizing the sensitivity to density of the fluid 202, especially when the fluid 202 is a steam that contains an aqueous component (i.e., liquid water).

For instance, the density of saturated water is 12.78 times the density of saturated steam (690 kg/m$^3$ versus 54 kg/m$^3$). On the other hand, the viscosity of saturated water is only 4.1 times the viscosity of saturated steam (0.082 cP versus 0.02 cP). Accordingly, the flow control device 200 may be designed or otherwise able to achieve a flow within the channel 212 that is less sensitive to the steam saturation if the restriction caused by the distance 210 of the channel 212 is dominated by viscosity rather than by density. As a result, more uniform amounts of both gaseous steam and water may be introduced into the channel 212 and expelled into the formation 108, as opposed to expelling uneven amounts of either gaseous steam or water and thereby not providing an equal injection rate along the work string 126.

For laminar flow, the pressure restriction of the channel 212 may be approximately given by the following equation:

$$\Delta P = \frac{12\ \mu L V}{h^2} \qquad \text{Equation (1)}$$

where μ is the absolute viscosity of the fluid 202, L is the length of the channel 212, V is the bulk flow velocity of the fluid 202 within the channel 212, and h is the distance 210 between the inner and outer shrouds 206*a,b*.

For turbulent flow, the pressure restriction provided by the channel 212 may be approximately given by the following equation:

$$\Delta P = \frac{\rho L V^2 f}{4h} \qquad \text{Equation (2)}$$

where ρ is the mass density of the fluid 202, and f is the friction factor of the channel 212. Whether laminar or turbulent flow is desired will depend on the application from well to well, such as how much pressure drop is desired along the work string 126 for the particular well and the costs required to obtain such a pressure drop. As will be appreciated by those skilled in the art, a pressure drop along the work string 126 may prove advantageous in balancing the flow of the fluid 202 out of the work string 126 such that a change in the permeability of the surrounding formation 108 does not dominate SAGD injection operations.

If the flow control device 200, or otherwise the channel 212, is designed to operate in laminar flow, then the pressure drop along the length of the work string 126 will be dominated by the viscous effects of the fluid 202. If, however, the flow control device 200, or otherwise the channel 212, is designed to operate in turbulent flow, then the density of the fluid 202 will dominate. With rare exception, turbulent flow of the fluid 202 will result in a larger pressure drop along the length of the work string 126.

The work string 126 may have one or more flow ports 214 defined therein and the channel 212 may be fluidly coupled to the one or more flow ports 214 such that the fluid 202 may be conveyed to the flow ports 214 via the channel 212. While two flow ports 214 are illustrated in FIG. 2, in some embodiments only one flow port 214 may be employed, and in other embodiments, more than two flow ports 214 may be employed, without departing from the scope of the disclosure.

The inner and outer shrouds 206*a,b* may be coupled to the work string 126 and extend longitudinally in the uphole direction (i.e., to the left in FIG. 2 and opposite the direction 204). In some embodiments, the inner and outer shrouds 206*a,b* may be welded, brazed, or crimped to the work string 126. In other embodiments, however, the inner and outer shrouds 206*a,b* may be fastened to the work string 126 using one or more mechanical fasteners such as, but not limited to, bolts, screws, pins, c-rings, clamps combinations thereof, and the like.

Figure 3:
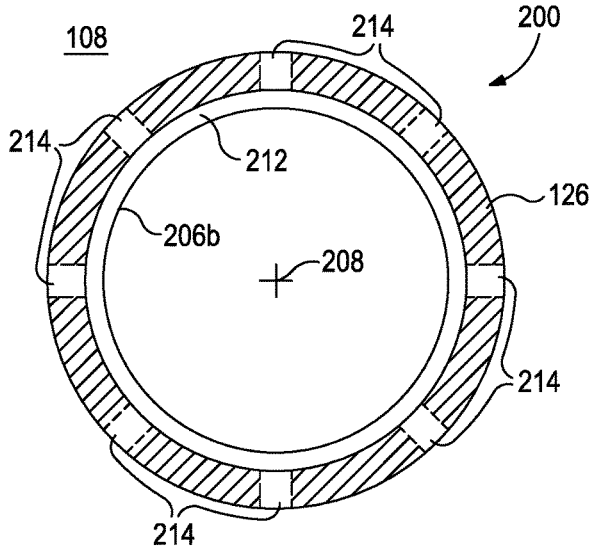
FIG. 3 is a cross-sectional view of the flow control device of FIG. 2, as taken along the lines A-A in FIG. 2, according to one or more embodiments.

Referring briefly to FIG. 3, with continued reference to FIG. 2, illustrated is a cross-sectional view of the flow control device 200, as taken along the lines A-A in FIG. 2. As illustrated, the work string 126 may have several flow ports 214 defined therein about its circumference and in fluid communication with the channel 212, thereby providing fluid communication with the surrounding subterranean formation 108. In some embodiments, the flow ports 214 may be equidistantly spaced from each other about the work string 126. In other embodiments, however, the flow ports 214 may be randomly spaced from each other, without departing from the scope of the disclosure. The outer shroud 206*b* is shown radially offset from the work string 126 a short distance toward the central axis 208.

Referring again to FIG. 2, the work string 126 may include a first or uphole portion 218*a* and a second or downhole portion 218*b*. The uphole and downhole portions 218*a,b* may be coupled or otherwise connected together using a coupling 216 which may threadably engage each of the uphole and downhole portions 218*a,b* and otherwise form an integral part of the work string 126. In other embodiments, however, the coupling 216 may be welded, brazed, or mechanically fastened to one or both of the uphole and downhole portions 218*a,b* of the work string 126, without departing from the scope of the disclosure. As illustrated, the inner and outer shrouds 206*a,b* may be coupled to the work string 126 at the coupling 216 in at least one embodiment. Accordingly, in some embodiments, the one or more flow ports 214 may be defined in the coupling 216.

In some embodiments, the inner shroud 206*a* may be longer than the outer shroud 206*b* such that the inner shroud 206*a* may include or otherwise define an axial extension 220 (shown in dotted lines). The axial extension 220 may prove advantageous in embodiments where the fluid 202 includes aqueous and gaseous fluid components. For instance, the axial extension 220 creates an area of lower fluid velocity where the outer shroud 206*b* fails to extend longitudinally. Such an area of lower fluid velocity near the inner wall of the work string 126 may help draw the aqueous and gaseous fluid components into the channel 212 at substantially the same flow rate. Once the fluid 202 begins to proceed within the channel 212, the aqueous component becomes trapped within the channel 212 as a result of the back pressure generated within the work string 126. As a result, the aqueous component is forced to flow within the channel 212 and eventually exits at the flow port(s) 214. Accordingly, the axial extension 220 may be configured to balance the injection of aqueous and gaseous components of the fluid 202 during injection operations.

In some embodiments, the axial extension 220 may extend substantially parallel with the remaining portions of the inner and outer shrouds 206*a,b*, as indicated by the axial extension 220*a*. In other embodiments, the axial extension 220 may scoop or otherwise bend inward toward the central axis 208, as indicated by the axial extension 220*b*. In such embodiments, the axial extension 220*b* may be configured to funnel a greater amount of aqueous component of the fluid 202 into the channel 212. In yet other embodiments, the axial extension 220 may bend away from the central axis 208, as indicated by the axial extension 220*c*. In such embodiments, the axial extension 220*c* may be configured to funnel a lesser amount of aqueous component of the fluid 202 into the channel 212. As will be appreciated, the flow of the fluid 202 (and its fluid components) into the channel 212 may be regulated by manipulating the angle of the axial extension 220 (i.e., either toward or away from the central axis 208).

In some embodiments, the flow control device 200 may be arranged on or otherwise attached to the outer diameter of the work string 126, as indicated by the dashed lines 222 (shown only on the top side of the work string 126). In such an embodiment, the inner and outer shrouds 206*a,b*, shown as dashed lines 224*a* and 224*b*, may be coupled to the work string 126 or the coupling 216 and similarly provide a channel 226 for the fluid 202 to be injected into the surrounding subterranean formation 108. The channel 226 may again provide fluid resistance to the flow of the fluid 202 such that injection of the fluid 202 into the formation 108 is slowed or otherwise regulated.

Figure 4A:
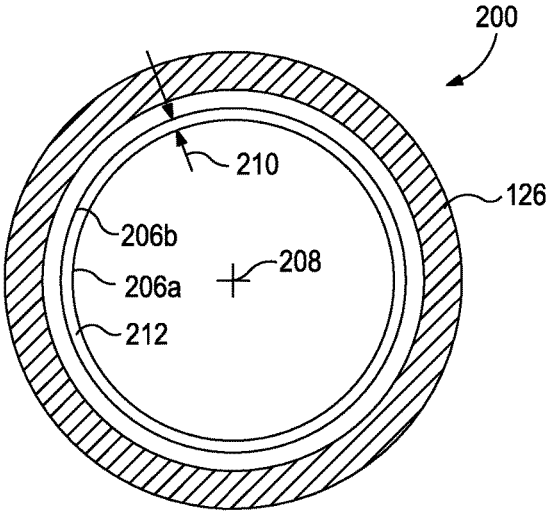
FIGS. 4*a*-4*c* are cross-sectional views of the flow control device of FIG. 2, as taken along the lines B-B in FIG. 2, according to one or more embodiments.
Figure 4B:
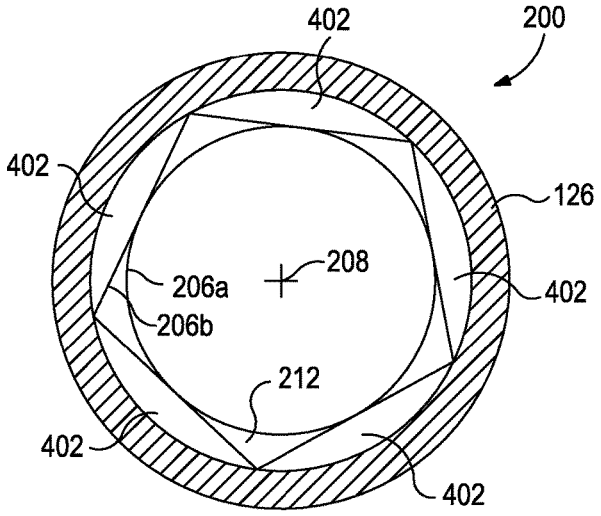
Figure 4C:
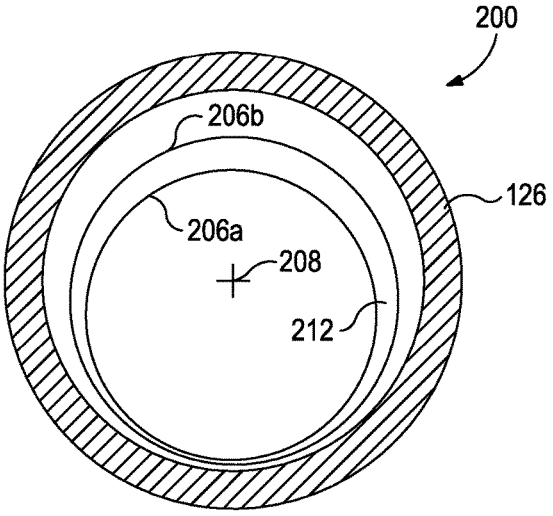

Referring now to FIGS. 4A-4C, with continued reference to FIG. 2, illustrated are exemplary cross-sectional views of the flow control device 200, as taken along lines B-B in FIG. 2. In some embodiments, as depicted in FIG. 4A, each shroud 206*a,b* may be generally circular in shape and the inner shroud 206*a* may be concentric with the outer shroud 206*b* while the outer shroud 206*b* may be concentric with the work string 126. As a result, the channel 212 defined between the inner and outer shrouds 206*a,b* may be generally annular.

In other embodiments, however, as depicted in FIG. 4B, the inner and outer shrouds 206*a,b* may be generally concentric, but one or both shrouds 206*a,b* may exhibit a shape other than circular. For example, the outer shroud 206*b* may be polygonally-shaped, such as in the general shape of a pentagon or any other polygonal shape. In other embodiments, the inner shroud 206*a* may be polygonally-shaped while the outer shroud 206*b* may be generally circular. In yet other embodiments, both the inner and outer shrouds 206*a,b* may be polygonally-shaped, without departing from the scope of the disclosure. By having the outer shroud 206*b* polygonally-shaped, as depicted, the outer shroud 206*b* may be coupled to or otherwise engage the inner surface of the work string 126 at two or more points such that corresponding axial channels 402 may be formed that allow the fluid 202 to flow therethrough and past the flow control device 200.

In some embodiments, as depicted in FIG. 4C, one or both of the inner and outer shrouds 206*a,b* may be eccentric with the central axis 208. Moreover, in some embodiments, the inner shroud 206*a* may be eccentric with the outer shroud. Those skilled in the art will readily appreciate the several different configurations and shapes that one or both of the inner and outer shrouds 206*a,b* may take on without departing from the scope of the disclosure. In at least some embodiments, for example, one or both of the inner and outer shrouds 206*a,b* may be in the general shape of an ellipse or the like.

Figure 5:
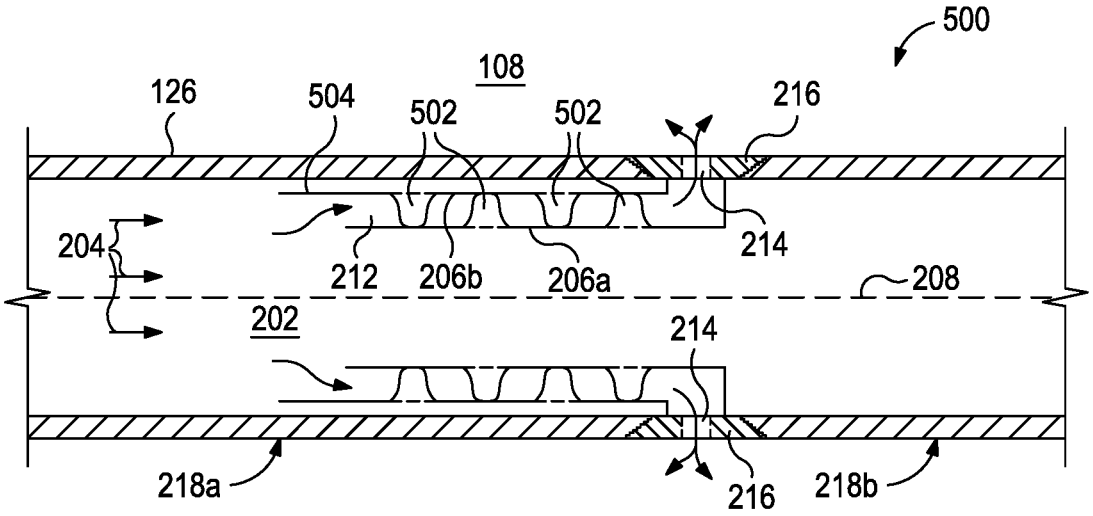
FIG. 5 is a cross-sectional view of a portion of an exemplary flow control device, according to one or more embodiments.

Referring now to FIG. 5, illustrated is another exemplary flow control device 500, according to one or more embodiments. The flow control device 500 may be similar in some respects to the flow control device 200 of FIG. 2 and therefore may be best understood with reference thereto, where like numerals will represent like elements not described again in detail. Similar to the flow control device 200 of FIG. 2, the flow control device 500 may be a generally annular structure that includes the inner and outer shrouds 206*a,b* arranged within or otherwise coupled to the work string 126. The inner and outer shrouds 206*a,b* may be coupled to the work string 126 itself, but may alternatively be coupled to the coupling 216, as illustrated. It will be appreciated, however, that the inner and outer shrouds 206*a,b* may equally be arranged on the outer surface of the work string 126, as generally described above, without departing from the scope of the disclosure.

The flow control device 500 may further include a plurality of dimples 502 being defined on one or both of the inner and outer shrouds 206*a,b* and otherwise extending into the channel 212. In the illustrated embodiment of FIG. 5, the dimples 502 are defined on both the inner and outer shrouds 206*a,b*. In operation, the dimples 502 may serve to increase the effective length of the flow path through the channel 212 that the fluid 202 is required to traverse before exiting via the flow ports 214. The dimples 502 may also be configured to reduce the flow area within the channel 212, thereby advantageously increasing the flow velocity and the pressure drop.

Figure 6A:
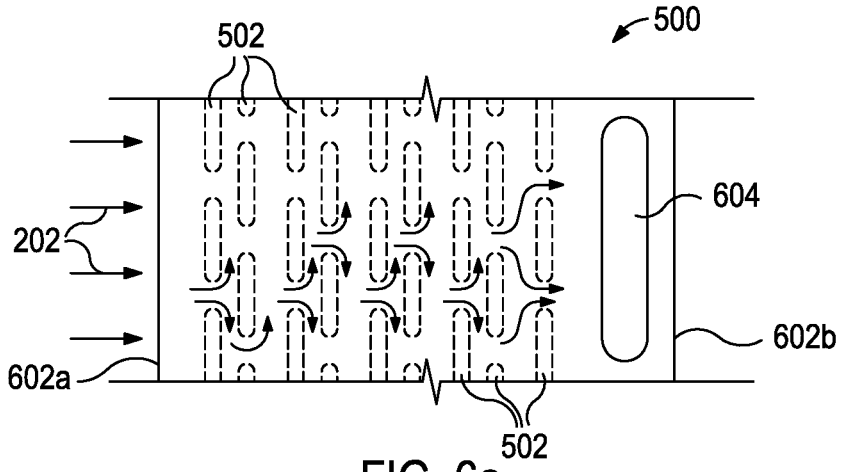
FIGS. 6*a*-6*c* illustrate planar, unwrapped views of different embodiments of the flow control device of FIG. 5, according to at least three embodiments, respectively
Figure 6B:
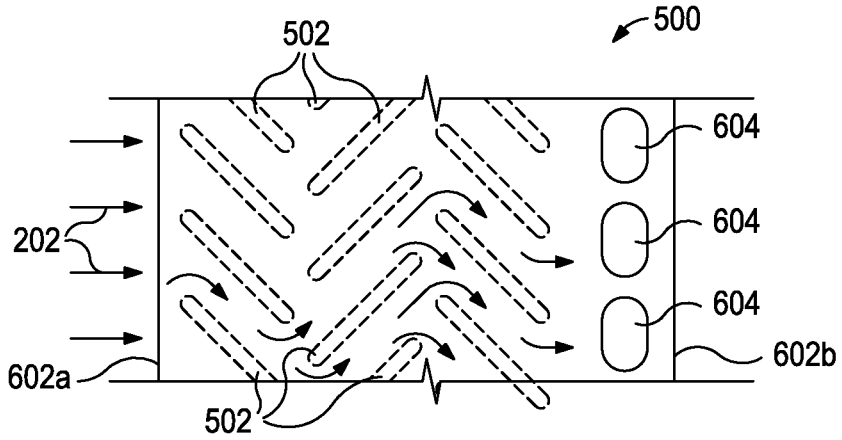
Figure 6C:
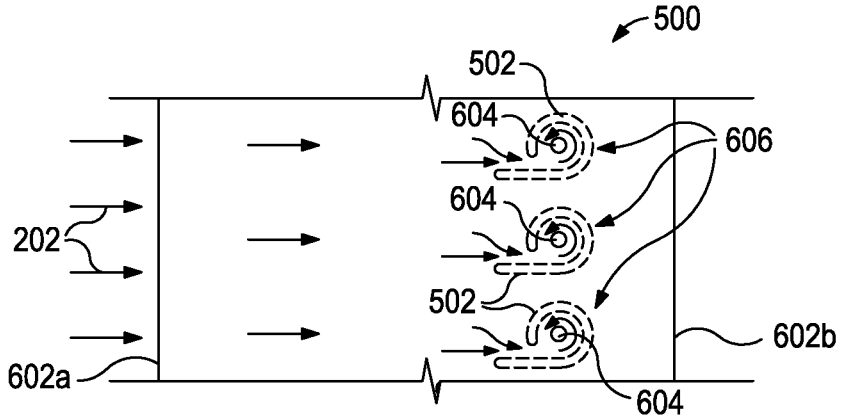

Referring briefly to FIGS. 6*a*-6*c*, with continued reference to FIG. 5, illustrated are planar, unwrapped views of different embodiments of the flow control device 500 of FIG. 5. In particular, FIGS. 6*a*-6*c* depict partial unwrapped views of the flow control device 500, according to at least three embodiments, respectively. As illustrated, the flow control device 500 may have an uphole end 602*a* and a downhole end 602*b*. At the uphole end 602*a*, the flow of the fluid 202 may enter the channel 212 (FIG. 5) and begin to make its way to the downhole end 602*b*. The various dimples 502 defined on the flow control device 500 provide a tortuous flow path for the fluid to flow from one end to the other.

The flow path provided in FIG. 6*a*, for example, may be characterized as an axial-radial combination flow path, where the fluid 202 is able to flow axially a short distance before encountering a dimple 502 which requires the fluid 202 to change its course in a radial direction. After flowing around the obstructing dimple 502 in a radial direction, the fluid 202 may then again be able to flow axially a short distance before encountering another dimple 502 and the process is repeated until the fluid 202 reaches the downhole end 602*b* and is able to exit the channel 212 via one or more flow exits 604 (one shown) which fluidly communicate with the flow ports 214 (FIG. 5).

The flow path provided in FIG. 6*b* may be characterized as a rotation/counter-rotation combination flow path, where the fluid 202 is required to change flow direction with each succeeding dimple 502 it encounters as the fluid progresses from the uphole end 602*a* to the downhole end 602*b*. Specifically, the dimples 502 in FIG. 6*b* may be configured to force the fluid 202 to change flow direction between clockwise and counterclockwise fluid rotations. After coursing through the various dimples 502 from the uphole end 602*a* to the downhole end 602*b*, the fluid 202 may be able to exit the channel 212 via one or more flow exits 604 (three shown) which fluidly communicate with the flow ports 214 (FIG. 5).

The flow path provided in FIG. 6*c* may be characterized as a fluidic diode, where the dimples 502 are formed such that they force the fluid 202 into one or more vortex diodes 606 configured to receive and spin the fluid 202. Spinning the fluid 202 increases the effective length of the flow path followed by the fluid 202 and thereby slows its progress through the flow control device 500. Specifically, the vortex diodes 606 may be configured to receive the fluid 202 in a generally axial direction and convert that axial flow into rotational flow such that the fluid 202 is forced to flow faster, thereby resulting in an increased pressure drop along the work string 126. After spinning within the corresponding vortex diodes, the fluid 202 can eventually exit the channel 212 via the one or more flow exits 604 (three shown) which fluidly communicate with the flow ports 214 (FIG. 5).

The flow path designs shown in FIGS. 6*a*-6*c* are shown merely for illustrative purposes and should not be considered as limiting to the present disclosure. Indeed, as will be appreciated by those skilled in the art, several flow path designs using various designs and configurations of dimples 502 may be developed and utilized in order to lengthen the flow path of the fluid 202 and reduce the flow area within the channel 212, thereby increasing the flow velocity and the pressure drop.

Referring again to FIG. 5, in some embodiments, the outer shroud 206*b* may be longer than the inner shroud 206*a* in the longitudinal direction such that the outer shroud 206*b* may include or otherwise define an axial extension 504. The axial extension 504 may allow an additional gaseous component of the fluid 202 to enter the channel 212 as opposed to an aqueous component of the fluid 202. Such a feature may be desired to balance the flow of the fluid 202 along the length of the work string 126. As will be appreciated, the axial extension 504 on the outer shroud 206*b* may be a feature of the embodiments discussed herein, without departing from the scope of the disclosure. Likewise, the axial extension 220 of FIG. 2 may equally be used in any of the embodiments discussed herein, including the flow control device 500 of FIG. 5.

Those skilled in the art will readily recognize the additional structural advantages that the dimples 502 may provide to the flow control device 500. For instance, the dimples 502 may help with manufacturing tolerances by maintaining the inner and outer shrouds 206*a,b* separated by a fixed distance and otherwise help maintain the shrouds 206*a,b* in a generally concentric relationship with respect to each other. The dimples 502 may also prove advantageous in preventing collapse of the channel 212.

Figure 7:
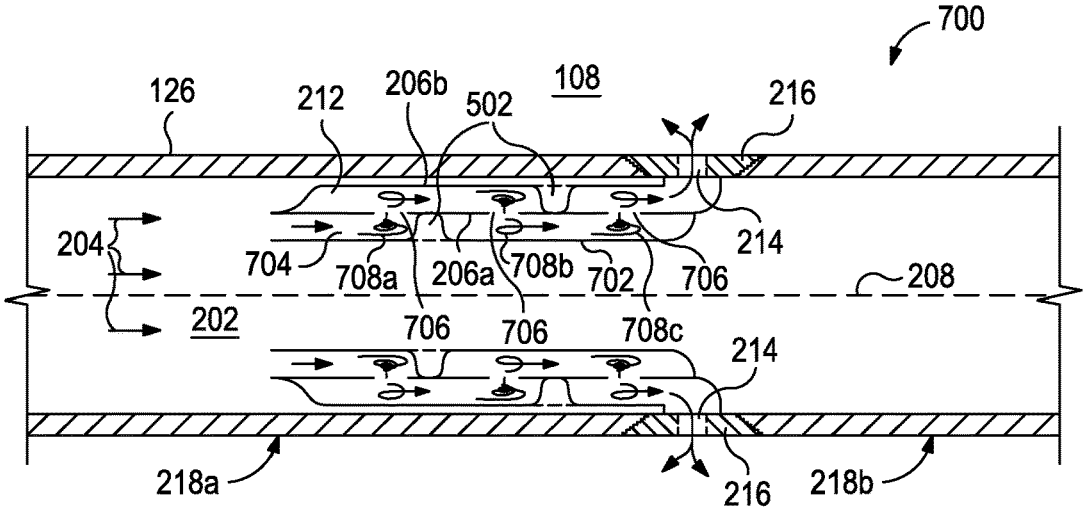
FIG. 7 is a cross-sectional view of a portion of an exemplary flow control device, according to one or more embodiments.

Referring now to FIG. 7, illustrated is another exemplary flow control device 700, according to one or more embodiments. The flow control device 700 may be similar in some respects to the flow control devices 200 and 500 of FIGS. 2 and 5 and therefore may be best understood with reference thereto, where like numerals will represent like elements not described again in detail. Similar to the flow control devices 200 and 500, the flow control device 700 may be a generally annular structure coupled to the work string 126 to control a flow of fluid 202 into a surrounding subterranean formation 108. Moreover, while the flow control device 700 is depicted as being arranged within the work string 126, the flow control device 700 may equally be arranged on the outer surface of the work string 126, as generally described above, without departing from the scope of the disclosure.

Unlike the flow control devices 200 and 500, however, the flow control device 700 may include a third and innermost shroud 702 radially offset from the inner shroud 206*a* toward the central axis 208. A second or inner channel 704 may be defined between the innermost shroud 702 and the inner shroud 206*a* and otherwise configured to receive the fluid 202 and fluidly communicate with the first or outer channel 212.

The flow control device 700 may further include a plurality of dimples 502 defined or otherwise formed on one, two, or all of the shrouds 206*a,b*, 702. In the illustrated embodiment, the dimples 502 are defined on the innermost shroud 702 and the outer shroud 206*b*, and the inner shroud 206*a* may define a plurality of flow exits 706 that provide fluid communication between the channels 212, 704. It will be appreciated, however, that in some embodiments the inner shroud 206*a* may also provide or otherwise define dimples 502 in addition to or otherwise in place of the dimples 502 defined by the innermost shroud 702 and the outer shroud 206*b*.

In some embodiments, the dimples 502 may form fluidic diodes, similar to the vortex diodes 606 described above with reference to FIG. 6*c*. Accordingly, in at least one embodiment, the dimples 502 may be configured to generate fluidic vortices, such as a first vortex 708*a*, a second vortex 708*b*, and a third vortex 708*c*, each of which communicate the fluid 202 through corresponding fluid exits 706 defined in the inner shroud 206*a*. After circulating through the various vortices 708*a-c*, the fluid 202 is able to escape the flow control device 700 via the flow port(s) 214.

Figure 8A:
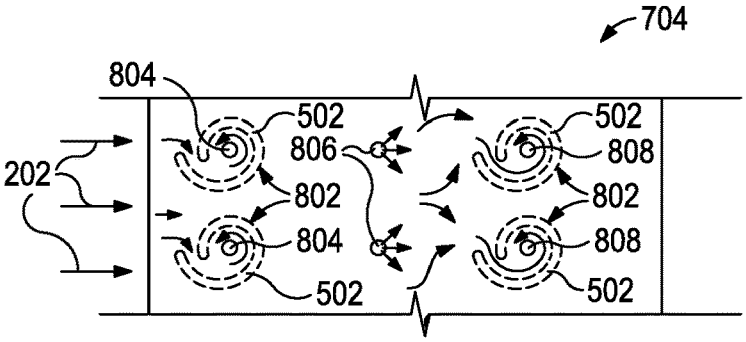
FIGS. 8*a* and 8*b* illustrate planar, unwrapped views of portions of the flow control device of FIG. 7, according to one or more embodiments.
Figure 8B:
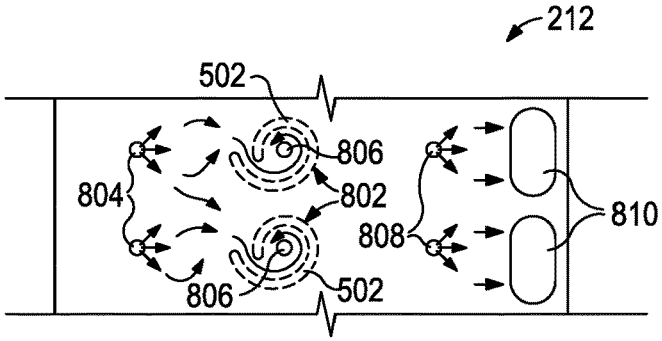

Referring briefly to FIGS. 8*a* and 8*b*, with continued reference to FIG. 7, illustrated are planar, unwrapped views of the flow control device 700 of FIG. 7. In particular, FIG. 8*a* depicts a partial unwrapped view of the inner channel 704 of the flow control device 700 and FIG. 8*b* depicts a partial unwrapped view of the outer channel 212 of the flow control device 700, according to one or more embodiments. The inner and outer channels 704, 212 may fluidly communicate with each other, as briefly discussed above, via fluidic diodes, such as one or more vortex diodes 802 that may be defined by the dimples 502.

The fluid 202 may initially enter the flow control device 700 via the inner channel 704, as depicted in FIG. 8*a*. As with the vortex diodes 606 of FIG. 6*c*, the vortex diodes 802 of FIG. 8*a* may be configured to receive the fluid 202 in a generally axial direction within the inner channel 704 and convert that axial flow into rotational flow such that the fluid 202 is forced to spin and flow faster, thereby resulting in an increased pressure drop. After spinning within a corresponding vortex diode 802, the fluid 202 may eventually exit the inner channel 704 via the one or more first flow exits 804 (two shown) which fluidly communicate with the outer channel 212.

Referring to FIG. 8*b*, the fluid 202 from the inner channel 704 may flow into the outer channel 212 via the one or more first flow exits 804 and flow axially until encountering an additional one or more vortex diodes 802. After spinning within a corresponding vortex diode 802, the fluid 202 may eventually exit the outer channel 212 via one or more second flow exits 806 (two shown) which fluidly communicate with the inner channel 704.

Referring again to FIG. 8*a*, the fluid 202 from the outer channel 212 may flow into the inner channel 704 via the one or more second flow exits 806 and flow axially until encountering an additional one or more vortex diodes 802. After spinning within a corresponding vortex diode 802, the fluid 202 may eventually exit the inner channel 212 once again via one or more third flow exits 808 (two shown) which fluidly communicate with the outer channel 212. As illustrated in FIG. 8*b*, the fluid 202 from the inner channel 704 may flow into the outer channel 704 once again via the one or more third flow exits 808 and flow axially toward one or more fourth flow exits 810 which fluidly communicate with the flow port(s) 214 (FIG. 7) and are thereby able to escape into the surrounding formation 108.

Figure 9:
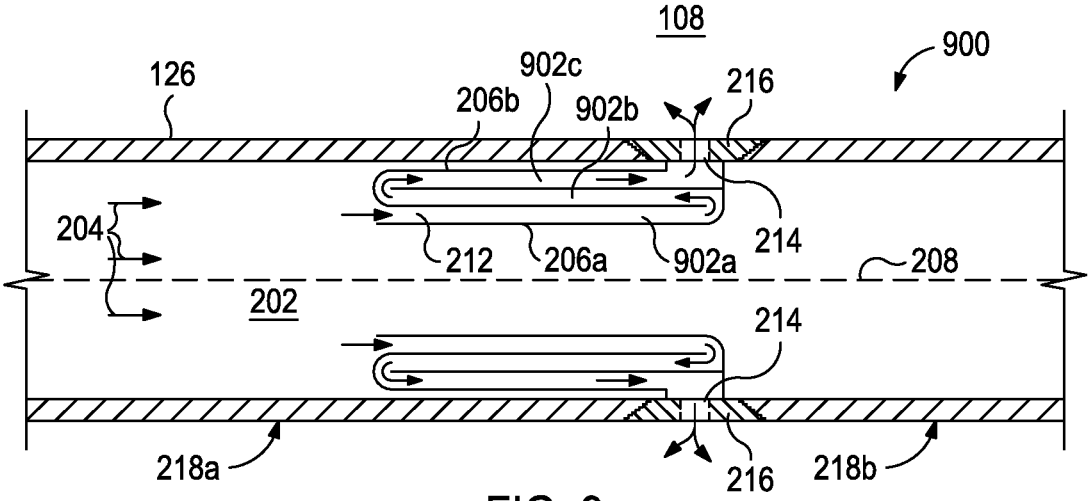
FIG. 9 is a cross-sectional view of a portion of an exemplary flow control device, according to one or more embodiments.

Referring now to FIG. 9, illustrated is another exemplary flow control device 900, according to one or more embodiments. The flow control device 900 may be similar in some respects to the flow control devices 200, 500, and 700 of FIGS. 2, 5, and 7, respectively, and therefore may be best understood with reference thereto, where like numerals will represent like elements not described again in detail. Similar to the flow control devices 200, 500, and 700, the flow control device 900 may be a generally annular structure coupled to the work string 126 to control a flow of fluid 202 into a surrounding subterranean formation 108. Moreover, while the flow control device 900 is depicted as being arranged within the work string 126, the flow control device 900 may equally be arranged on the outer surface of the work string 126, as generally described above, without departing from the scope of the disclosure.

As illustrated, the flow control device 900 may include the inner and outer shrouds 206*a,b* and a channel 212 may be formed between the two for conveying the fluid 202 to the flow ports 214. Portions of the inner and outer shrouds 206*a,b*, however, may be nested within each other such that the channel 212 directs the fluid 202 within the channel 212 in a generally downhole direction over a first section 902*a*, in a generally uphole direction over a second section 902*b*, and in a generally downhole direction again over a second section 902*c*. As depicted, each of the inner and outer shrouds 206*a,b* may be folded or otherwise configured to define the first, second, and third sections 902*a,b,c* of the channel 212. As a result, the flow control device 900 may be configured to convey the fluid 202 within a narrow channel that lengthens the flow path that the fluid 202 is required to traverse before exiting the work string 126 at the flow ports 214, and thereby advantageously creating a pressure drop.

Figure 10:
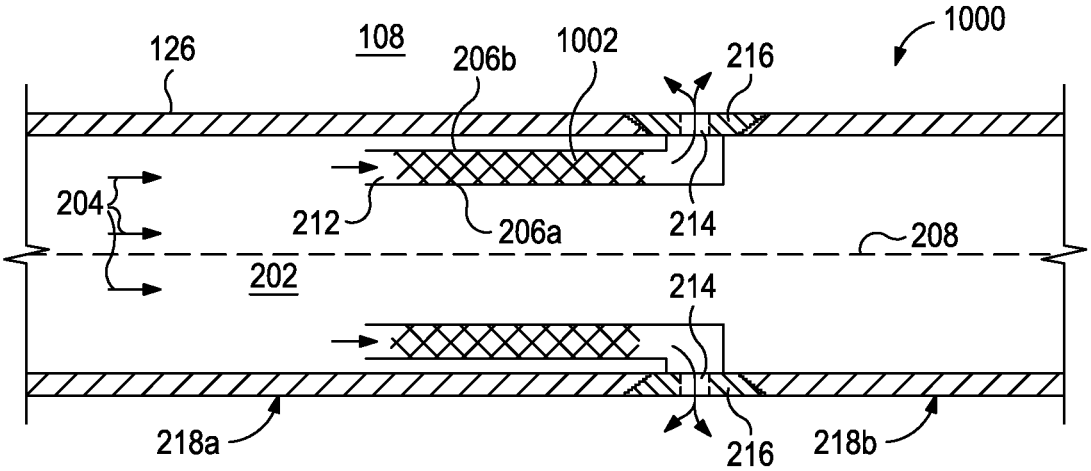
FIG. 10 is a cross-sectional view of a portion of an exemplary flow control device, according to one or more embodiments.

Referring now to FIG. 10, illustrated is another exemplary flow control device 1000, according to one or more embodiments. The flow control device 1000 may be similar in some respects to the flow control device 200 of FIG. 2, and therefore may be best understood with reference thereto, where like numerals will represent like elements not described again in detail. Similar to the flow control device 200, the flow control device 1000 may be a generally annular structure having inner and outer shrouds 206*a,b* coupled to the work string 126 to control a flow of fluid 202 into a surrounding subterranean formation 108. Moreover, while the flow control device 1000 is depicted as being arranged within the work string 126, the flow control device 1000 may equally be arranged on the outer surface of the work string 126, as generally described above, without departing from the scope of the disclosure.

Unlike the flow control device 200 of FIG. 2, however, the flow control device 1000 may include a porous medium 1002 disposed or otherwise arranged within at least a portion of the channel 212. In some embodiments, the porous medium 1002 may be a wire mesh, such as steel wool or the like. In other embodiments, however, the porous medium 1002 may be, but is not limited to, woven wire meshes and/or matrices, screens, porous foams, sand, gravel, proppant, rods, combinations thereof, and the like. In general, the porous medium 1002 may be any porous substance or material that allows a restricted amount of a fluid to pass therethrough.

In operation, the porous medium 1002 may be configured to increase the pressure drop of the fluid 202 in the flow control device 1000. By including the porous medium 1002, the fluid 202 may be conveyed through the porous medium 1002 and otherwise required to traverse crenellations and/or a more tortuous flow path before exiting via the flow ports 214. As the fluid 202 courses through the porous medium 1002, the fluid may start to behave like a Darcy flow that exhibits a pressure drop roughly approximated by the following equation:

$$\Delta P = \frac{\mu L V}{k} \qquad \text{Equation (3)}$$

where k is the permeability of the porous medium 1002.

As will be appreciated, the porous medium 1002 may be included in any of the embodiments described herein, without departing from the scope of the disclosure. For example, the porous medium 1002 may be added to the flow control devices 500 and 700 of FIGS. 5 and 7, respectively, and the combination of the dimples 502 and the porous medium 1002 may provide an adjustable pressure drop and a reduced tool length. Similar to the dimples 502, those skilled in the art will readily recognize the additional structural advantages that the porous medium 1002 may provide to the flow control device 1000. For instance, the porous medium 1002 may help with manufacturing tolerances by maintaining the inner and outer shrouds 206*a,b* separated by a fixed distance and otherwise help maintain the shrouds 206*a,b* in a generally concentric relationship with respect to each other. The porous medium 1002 may also prove advantageous in preventing collapse of the channel 212.

Figure 11:
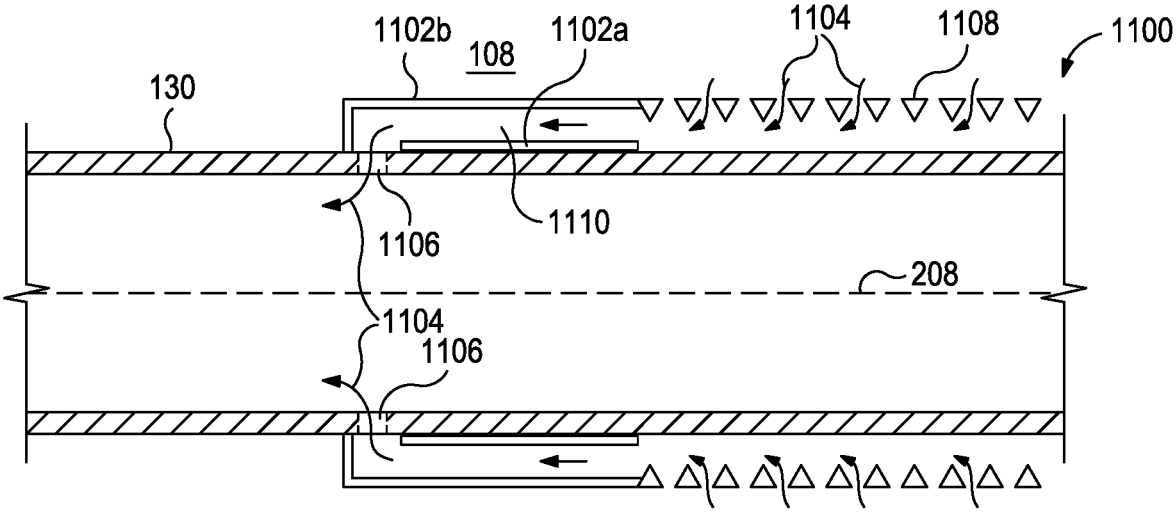
FIG. 11 is a cross-sectional view of a portion of an exemplary flow control device, according to one or more embodiments.

Referring now to FIG. 11, with reference to FIG. 1, illustrated is a cross-sectional view of yet another exemplary flow control device 1100, according to one or more embodiments. Similar to other flow control devices described herein, the flow control device 1100 may be a generally annular structure that includes an inner shroud 1102*a* and an outer shroud 1102*b* radially offset from the inner shroud 1102*a*. As illustrated, the flow control device 1100 may be coupled to or otherwise arranged about the extraction work string 130 and configured to regulate the flow of a fluid 1104 into the extraction work string 130 via one or more flow ports 1106. While two flow ports 1106 are shown in FIG. 11, those skilled in the art will readily appreciate that more or less than two flow ports 1106 may be employed, without departing from the scope of the disclosure.

As depicted, the flow control device 1100 may be arranged about the exterior of the extraction work string 130. In other embodiments, however, the flow control device 1100 may be equally arranged on the interior of the work string 130, without departing from the scope of the disclosure. Moreover, it will be appreciated that any of the flow control devices generally described herein may also be arranged about the exterior or interior of either the injection work string 126 or the extraction work string 130, without departing from the scope of the disclosure.

The flow control device 1100 may be operatively coupled to a screen filter 1108 also arranged about the exterior of the work string 130. The screen filter 1108 may be configured to filter or otherwise strain the fluid 1104 prior to being introduced into the flow control device 1100. In particular, the fluid 1104 may be introduced into the flow control device 1100 via a channel 1110 defined between the inner and outer shrouds 1102*a,b*. Similar to the channel 212 described above, the channel 1110 may create or otherwise define an annular area that generates a flow restriction for the incoming fluid 1104, thereby regulating the fluid flow into the work string 130.

In at least one embodiment, the inner shroud 1102*a* may be omitted or otherwise replaced functionally by the work string 130 itself. In other words, the work string 130 may functionally serve as the inner shroud 1102*a* in at least some embodiments, without departing from the scope of the disclosure. Moreover, any of the features or components described herein with respect to any of the flow control devices may equally be applied or otherwise employed in the flow control device 1100 of FIG. 11. For instance, the flow control device 1100 may include one or more of the plurality of dimples 502 of FIGS. 5 and 7, one or more of the fluidic diodes 606, 802 of FIGS. 6*c* and 8*a-b*, and the porous medium 1002 of FIG. 10, or any combination thereof, without departing from the scope of the disclosure.

Figure 12:
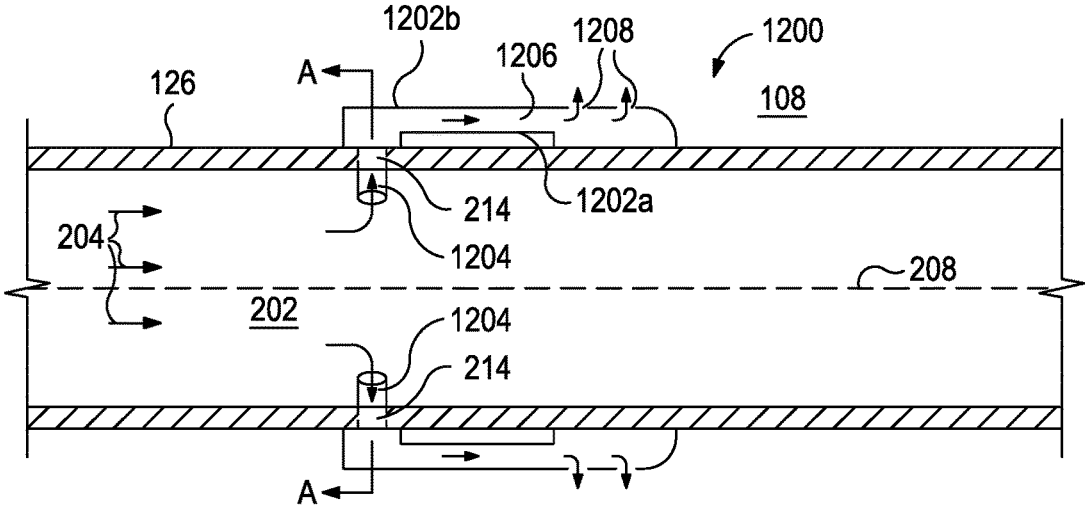
FIG. 12 is a cross-sectional view of a portion of an exemplary flow control device, according to one or more embodiments.

Referring now to FIG. 12, illustrated is a cross-sectional view of another flow control device 1200, according to one or more embodiments. The flow control device 1200 may be similar in some respects to one or more of the flow control devices discussed above and therefore may be best understood with reference thereto, where like numerals will represent like elements not described again. The flow control device 1200 may be a generally annular structure coupled to the work string 126 to control a flow of fluid 202 into a surrounding subterranean formation 108. As illustrated, the flow control device 1200 may include an inner shroud 1202*a* and an outer shroud 1202*b* radially offset from the inner shroud 1202*a*.

The flow control device 1200 may be generally arranged about the exterior of the work string 126 and may include one or more fluid conduits 1204 (two shown) fluidly coupled to the flow ports 214 defined in the work string 126 (or a coupling forming part of the work string 126). In particular, the fluid conduit 1204 may be a tubular length coupled to, attached to, or otherwise inserted at least partially within a corresponding flow port 214 and extending radially a short distance into the interior of the work string 126. The fluid conduits 1204 may be configured to convey the fluid 202 within the work string 126 to the flow port 214 which ejects the fluid 202 into a channel 1206 defined between the inner and outer shrouds 1202*a,b*. After circulating through the channel 2106, the fluid 202 may exit the flow control device 1200 via one or more flow exits 1208 defined in the outer shroud 2102*b* and otherwise providing fluid communication between the flow control device 1200 and the surrounding subterranean formation 108.

Figure 13:
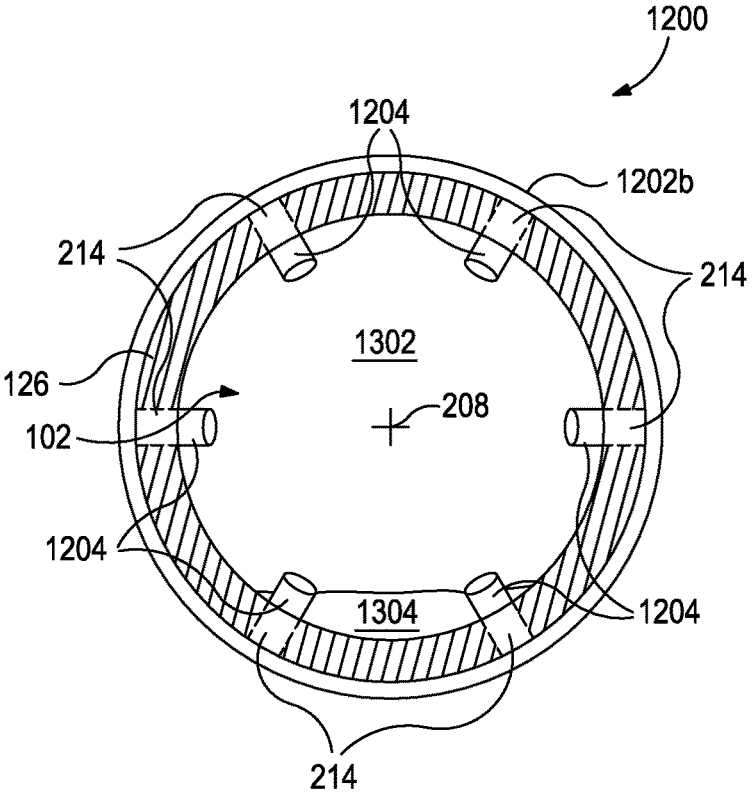
FIG. 13 is a cross-sectional view of the flow control device of FIG. 12, as taken along lines A-A of FIG. 12, according to one or more embodiments.

Referring briefly to FIG. 13, with continued reference to FIG. 12, illustrated is a cross-sectional view of the flow control device 1200 taken along lines A-A of FIG. 12. As illustrated, the flow control device 1200 may include fluid conduits 1204 used in conjunction with each flow port 214. In other embodiments, however, the fluid conduits 1204 may be used in conjunction with only one or some, but not all, of the flow ports 214. While six flow ports 214 are depicted in FIG. 12, those skilled in the art will readily recognize that more or less than six flow ports 214 may be employed, without departing from the scope of the disclosure. Moreover, as mentioned previously, the flow ports 214 may be equidistantly or randomly spaced from each other about the circumference of the work string 126. The outer shroud 1202*b* is shown radially offset from the work string 126 a short distance away from the central axis 208.

The work string 126 depicted in FIG. 13 may be arranged in a substantially horizontal configuration such that gravity separation may have occurred within the fluid 202. In particular, the fluid 202 is shown as having separated into a gaseous component 1302 and an aqueous component 1304, and the aqueous component 1304 has congregated at the bottom of the work string 126. In exemplary operation, before the aqueous component 1304 is able to exit the work string 126, the fluid level of the aqueous component 1304 must exceed the height of the fluid conduit(s) 1204 arranged at or near the bottom of the work string 126. If the fluid level does not exceed the height of the fluid conduit(s) 1204, the aqueous component 1304 flows past the flow control device 1200 in the direction 204 (FIG. 12) and to axially adjacent and subsequently arranged flow control devices (not shown) downhole within the work string 126.

Those skilled in the art will readily appreciate the advantages that the flow control device 1200 may provide. For instance, in horizontal steam injection wells, increased amounts of water are typically injected into the surrounding formation 108 near the heel of the well as opposed to the toe such that the toe of the well receives an increased amount of gaseous steam and the surrounding formation 108 is not heat treated efficiently. The exemplary flow control device 1200 may help convey an amount of the aqueous component 1304 (i.e., water) of the fluid 202 toward the toe of the well such that both the aqueous component 1304 and the gaseous component 1302 may be distributed substantially evenly along the length of the work string 126.

As will be appreciated, the depth or height of the fluid conduits 1204 (i.e., the distance the fluid conduit 1204 extends into the interior of the work string 126) may be varied or otherwise configured such that a predetermined amount of the aqueous component 1304 is able to be injected into the formation 108 at the flow control device 1200. In some embodiments, where the work string 126 may have several flow control devices 1200 axially aligned along a length of the work string 126, the depth or height of the fluid conduits 1304 in successive flow control devices 1200 may progressively decrease such that increased amounts of the aqueous component 1304 may be able to be injected into the formation 108 as the flow of the fluid 202 progresses in the downhole direction 204 (FIG. 12).

Figure 14:
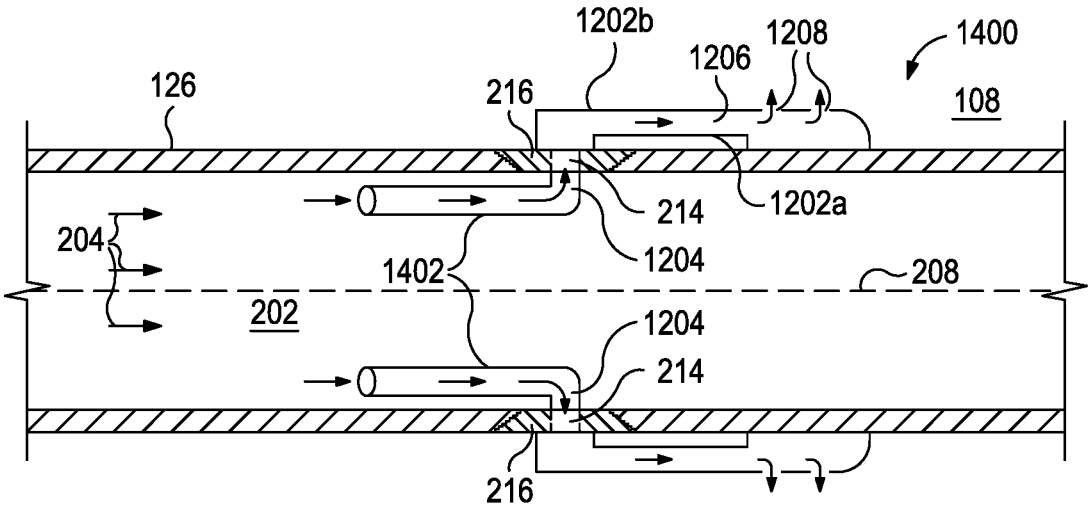
FIG. 14 is a cross-sectional view of a portion of an exemplary flow control device, according to one or more embodiments.

Referring now to FIG. 14, with continued reference to FIG. 12, illustrated is a cross-sectional view of another flow control device 1400, according to one or more embodiments. The flow control device 1400 may be similar in some respects to the flow control device 1200 of FIG. 12 and therefore may be best understood with reference thereto, where like numerals will represent like elements not described again. The flow control device 1400 may be a generally annular structure coupled to the work string 126 to control a flow of fluid 202 into the surrounding subterranean formation 108. As illustrated, the flow control device 1400 may include the inner and outer shrouds 1202*a,b* and may be generally arranged about the exterior of the work string 126.

Similar to the flow control device 1200 of FIG. 12, the flow control device 1400 may include one or more fluid conduits 1204 (two shown) fluidly coupled to the flow ports 214 defined in the work string 126 (or a coupling 216 forming part of the work string 126). One or more of the fluid conduits 1204 in the flow control device 1400, however, may include a longitudinal extension 1402 that extends in the uphole direction (e.g., opposite the direction 204). The longitudinal extension 1402 may be configured to initially receive the fluid 202 within the work string 126 and convey the trapped fluid 202 to the flow ports 214 for introduction into the channel 1206 defined between the inner and outer shrouds 1202*a,b*. In some embodiments, the longitudinal extension 1402 may prove advantageous in increasing the amount of gaseous component of the fluid 202 that is injected into the surrounding formation 108.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A flow control device, comprising:

an annular inner shroud coupled to a work string;

an annular outer shroud also coupled to a work string and offset from the work string such that a channel is defined between at least a portion of the inner shroud and the outer shroud, the channel being in fluid communication with at least one of one or more flow ports that are connected to one end of the outer shroud and configured to restrict a flow rate of a fluid; and a plurality of fluid conduits inserted at least partially into the one or more flow ports, the plurality of the fluid conduits comprising a plurality of radially spaced apart extensions that extend longitudinally within the work string, wherein fluid flowing through the plurality of radially spaced apart extensions flow into the channel defined between the portion of the inner shroud and outer shroud.

2. The flow control device of claim 1, further comprising a coupling forming an integral part of the work string and connecting an uphole portion of the work string to a downhole portion of the work string, wherein the one or more flow ports are defined in the coupling and the outer shroud is coupled to the coupling.

3. The flow control device of claim 1, further comprising an annular inner shroud coupled to the work string such that the channel is defined between at least a portion of the inner and outer shroud shrouds.

4. The flow control device of claim 3, wherein the axial extension bends inward toward a central axis of the work string.

5. The flow control device of claim 3, wherein the axial extension bends away from a central axis of the work string.

6. The flow control device of claim 3, further comprising:

an innermost shroud radially offset from the inner shroud toward a central axis of the work string such that an inner channel is defined between the innermost and inner shrouds, the inner channel being fluidly communicable with the channel via one or more flow exits defined in the inner shroud.

7. The flow control device of claim 3, wherein the inner and outer shrouds are folded such that portions of the inner and outer shrouds are nested within each other.

8. The flow control device of claim 1, wherein the outer shroud is circular in shape.

9. The flow control device of claim 1, wherein the fluid comprises a gaseous component and an aqueous component.

10. The flow control device of claim 1, wherein the plurality of radially spaced apart extensions that extend longitudinally within the work string in uphole direction.

11. The flow control device of claim 1, wherein the plurality of radially spaced apart extensions are configured to:

receive the fluid from the work string;

provide fluid flow paths for the fluid to flow through the plurality of radially spaced apart extensions and into the channel.

12. A method of regulating a flow of a fluid, comprising:

conveying the fluid in a work string defining one or more flow ports therein;

receiving a portion of the fluid in an annular flow control device arranged within and coupled to the work string, the annular flow control device including an inner shroud and an outer shroud offset from the inner shroud and defining a channel therebetween to receive the portion of the fluid, the channel being in fluid communication with at least one of one or more flow ports that are connected to one end of the outer shroud;

conveying the portion of the fluid through a plurality of fluid conduits of the annular flow control device, wherein the plurality of fluid conduits are inserted at least partially into the one or more flow ports and comprising a plurality of radially spaced apart extensions that extend longitudinally within the work string;

conducting the portion of the fluid through the channel and the at least one of the one or more flow ports, and thereby creating a flow restriction on the fluid through the annular flow control device; and obstructing a flow of the portion of the fluid with the plurality of radially spaced apart extensions.

13. The method of claim 12, wherein the fluid comprises a gaseous component and an aqueous component.

14. A method of regulating a flow of a fluid, comprising:

drawing the fluid into a work string defining one or more flow ports therein;

receiving the fluid in an annular flow control device coupled to the work string and including an inner shroud and an outer shroud offset from the inner shroud such that a channel is defined therebetween to receive the fluid, the channel being in fluid communication with at least one of one or more flow ports that are connected to one end of the outer shroud;

conveying the fluid through a plurality of fluid conduits of the annular flow control device, wherein the plurality of fluid conduits are inserted at least partially into the one or more flow ports and comprising a plurality of radially spaced apart extensions that extend longitudinally within the work string;

conducting the fluid through the channel and the at least one of the one or more flow ports, and thereby creating a flow restriction on the fluid through the annular flow control device; and obstructing a flow of the fluid with the plurality of radially spaced apart extensions.

15. The method of claim 14, wherein the annular flow control device is coupled to an exterior of the work string and receiving the fluid in the annular flow control device further comprises filtering the fluid through a screen filter prior to being introduced into the flow control device, the screen filter also being arranged about the exterior of the work string.

16. The method of claim 14, wherein the fluid comprises a gaseous component and an aqueous component.

* * * * *